US007549705B2

(12) United States Patent
Man et al.

(10) Patent No.: US 7,549,705 B2
(45) Date of Patent: Jun. 23, 2009

(54) CHAIR WITH MULTIPLE EXERCISING FUNCTIONS

(76) Inventors: Yan-Gao Man, 14310 Duvall Hill Ct., Burtonsville, MD (US) 20866; Guangping Gao, 2-312 TieLu Youyongchi Building, Huoju Rd., FanCheng District, Xiang Fan City, Hubei (CN)

( * ) Notice: Subject to any disclaimer, the term of this patent is extended or adjusted under 35 U.S.C. 154(b) by 16 days.

(21) Appl. No.: 11/836,831

(22) Filed: Aug. 10, 2007

(65) Prior Publication Data

US 2008/0100105 A1 May 1, 2008

(30) Foreign Application Priority Data

Oct. 28, 2006 (CN) ..... 2006 2 0099687 U

(51) Int. Cl.
*A47C 1/034* (2006.01)

(52) U.S. Cl. ..... 297/423.21; 297/69; 297/90; 482/132; 482/142

(58) Field of Classification Search ..... 297/68, 297/69, 75, 90, 423.2, 423.21; 482/129–133, 482/142

See application file for complete search history.

(56) References Cited

U.S. PATENT DOCUMENTS

| | | | | | |
|---|---|---|---|---|---|
| 256,793 | A * | 4/1882 | Chelini | 297/69 |
| 390,353 | A * | 10/1888 | Ecker et al. | 297/90 |
| 704,459 | A * | 7/1902 | Hanger | 297/83 |
| 809,596 | A * | 1/1906 | Witte | 297/90 |
| 2,539,023 | A * | 1/1951 | LaPlace | 297/69 |
| 2,717,630 | A * | 9/1955 | Dowler | 297/30 |
| 3,083,996 | A * | 4/1963 | Caldemeyer et al. | 297/75 |
| 5,277,477 | A * | 1/1994 | Sharff et al. | 297/423.21 |
| 5,690,594 | A * | 11/1997 | Mankovitz | 482/121 |
| 7,159,935 | B2 * | 1/2007 | Lai | 297/423.26 |

* cited by examiner

*Primary Examiner*—Peter R. Brown
(74) *Attorney, Agent, or Firm*—Ming Chow; Sinorica, LLC

(57) ABSTRACT

A multifunction office/fitness chair includes a backrest with an armrest and a seat connected with the backrest through a pivot. The backrest is also connected with a footrest through a footrest connection device. The backrest is able to rotate 90 degrees around the pivot, so that the chair can be switched among an office-chair state for work, a recliner state for exercise and a middle state for rest. A user can use the chair of the invention for work and for exercise in a bedroom or an office without limitations to access to equipment, location and time. Using the chair to exercise three to five minutes per day can help lose weight effectively.

2 Claims, 1 Drawing Sheet

CHAIR WITH MULTIPLE EXERCISING FUNCTIONS

This application claims the benefit of China application Serial No. 200620099687.X, filed on Oct. 28, 2006. The subject matter of which is incorporated herein by reference.

BACKGROUND OF THE INVENTION

1. Field of the Invention

The invention relates in general to a multifunction chair, and more particularly to a multifunction office/fitness chair.

2. Description of the Related Art

Because of the improvement of living conditions, more and more people have obesity problems. Diseases caused by obesity, such as hypertension, heart disease and other cardiovascular diseases, affect people's health seriously. However, limited to access to equipment, location and time, it is difficult for people to exercise at anywhere and anytime. Therefore, it is important to develop exercise equipments with minimum limitations.

SUMMARY OF THE INVENTION

The invention is directed to an office/fitness chair including a footrest lever. The footrest lever is a rectangular tube with an extendable shaft inserted therein. A footrest is fixed to a front end of the extendable shaft.

The invention is directed to an office/fitness chair including a roller disposed on a front end of the footrest lever.

The invention is directed to an office/fitness chair including a footrest positioning plate disposed on two sides of the footrest. The footrest positioning plate is fixed on a longitudinal bar under a seat.

The invention will become apparent from the following detailed description of the preferred but non-limiting embodiments. The following description is made with reference to the accompanying drawings.

DETAILED DESCRIPTION OF THE INVENTION

Figure 1:
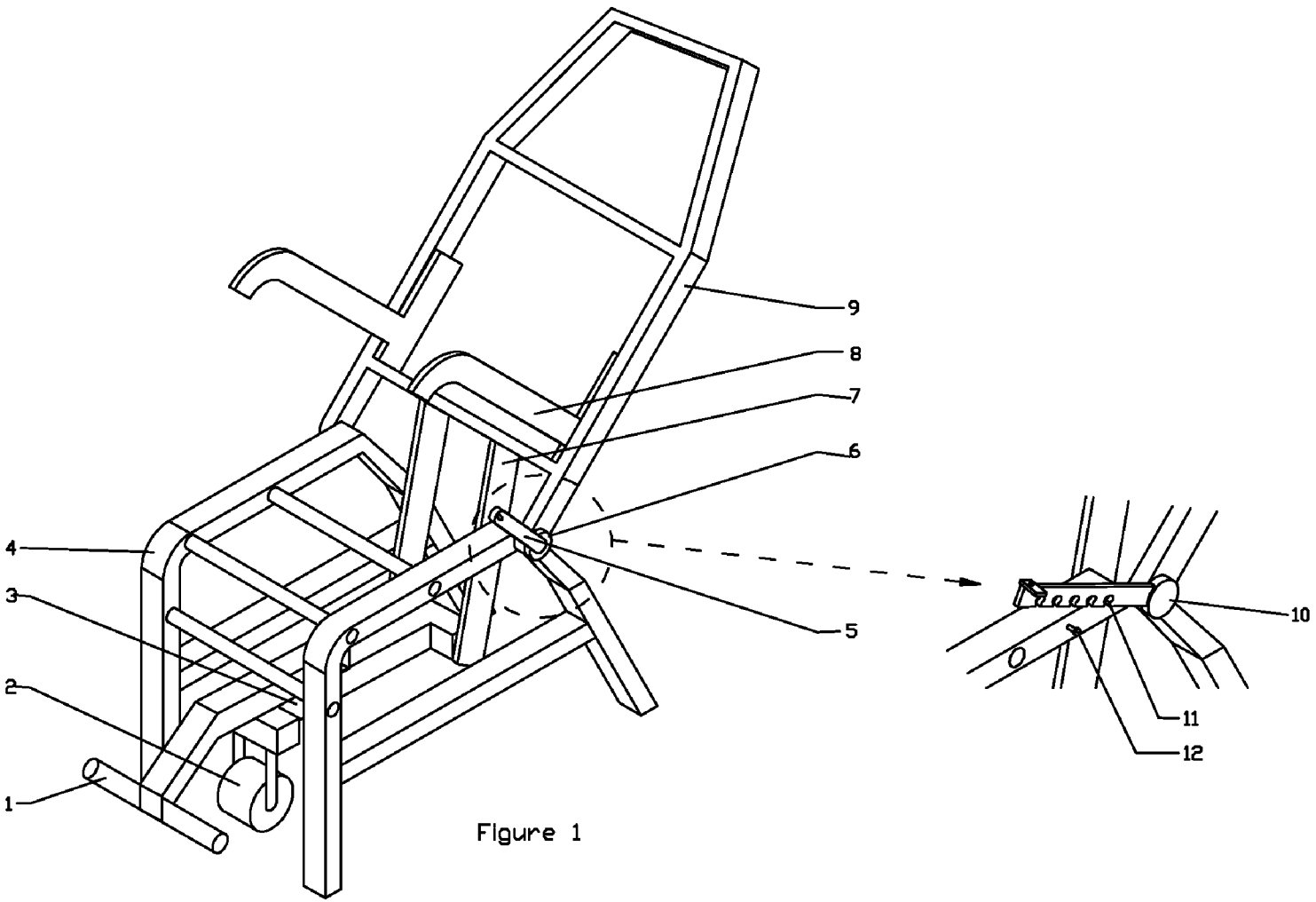
FIG. 1 illustrates a multifunction office/fitness chair according to the present invention.

A multifunction office/fitness chair of the present invention includes a backrest able to rotate 90 degrees around a pivot, so that the chair can be switched among an office-chair state for work, a recliner state for exercise and a middle state for rest. Chairs are necessary pieces of furniture not only in a home but also in an office. Most people spend hours on chairs every day. Therefore, adding exercise functions to the chair enables people to exercise in the bedroom or office without limitations to locations, equipments and time. Over ninety percent of obese people have excess fat stored in the abdominal area. The chair of the present invention enables people to perform abdominal exercise with high intensity and to consume more energy. According to the experiments on volunteers, after using the chair of the present invention for three to five minutes per day for two weeks, obvious effect is achieved. The volunteers have smaller waists and can breathe more easily.

The FIG. 1 illustrates detail components and structure of the current invention. An armrest 8 is fixed to a backrest 9, and the armrest 8 and the backrest are integrated and regarded as a unit. A pivot 6, with a pivot handle 5 is used for connecting and adjusting the backrest 9 and a seat 4. The backrest 9 is able to rotate 90 degrees around the pivot 6. A positioning plate 10 of the backrest 9 is fixed to the seat 4. The positioning plate 10 has positioning holes 11. A positioning pin 12 can be selectively inserted in one of the positioning holes to control the angle between the backrest 9 and the seat 4. The backrest 9 is connected with a footrest 1 through a footrest connection device. The footrest connection device includes a moving lever 7 and an extendable shaft 3. One end of the moving lever 7 is pivotally connected with the back of the backrest 9. The other end of the moving lever 7 is pivotally connected with the extendable shaft 3. The extendable shaft 3 is a rectangular tube and is connected with the footrest 1. The length of the extendable shaft 3 can be adjustable according to the height of a user. The footrest 1 is disposed on a front end of the extendable shaft 3. A roller 2 is disposed on a front end of the extendable shaft 3. The roller 2 can be placed on the ground, so that the user can extend the footrest 1 easily. Resistance force is reduced through the roller 2 when the extendable shaft 3 moves back and forth. When the multifunction office/fitness chair is used as an office chair, the positioning pin is inserted in the positioning hole of the positioning plate 10. When the multifunction office/fitness chair is used as a fitness chair, the positioning pin is pulled out. The backrest 9 is able to rotate around the pivot 6. As a result, the backrest 9 is inclined backward, and the footrest connection device is driven to move linearly under the seat 4. The extendable shaft 3 moves to the front of the chair, and the roller 2 rolls on the ground. Therefore, the chair can be switched among an office-chair state for work, a recliner state for exercise and a state for rest. When the user wants to exercise, the user only needs to lean back for pushing the backrest to a horizontal position. Meanwhile, the footrest is pushed out, and the armrest is inclined. The user stretches his/her legs and bends his/her arms. Also, the user lies on his/her back on the chair. Then, the user can use his/her arms and tighten the abdominal muscles to lean forward. At this moment, user's arms apply pressure to the armrest, and the backrest is driven to be inclined forward. The footrest is driven to move backward, so the user's legs move backward as well. The user's thighs are 90 degrees to the body, and the abdomen, waist, arms and legs are exercised well. The position of the backrest can be controlled by hands or legs. The user can decide the exercise time depending on his/her needs. Also, the user can do sit-ups when descending the backrest of the chair.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multifunction office/fitness chair comprising:

a backrest wherein the backrest is connected with a footrest through a footrest connection device;

an armrest fixedly connected with the backrest;

a seat connected with the backrest through a pivot;

a pivot with a pivot handle are disposed at a side of the backrest wherein positions of the backrest and the seat are adjusted by the pivot and the pivot handle, wherein the backrest is able to rotate 90 degrees around the pivot;

a positioning plate of the backrest is fixed to the seat;

the footrest connection device includes a moving lever and an extendable shaft, wherein one end of the moving lever is pivotally connected with back of the backrest and another end of the moving lever is pivotally connected with the extendable shaft;

the extendable shaft is a rectangular tube and is connected with the footrest, wherein length of the extendable shaft is adjustable according to height of an user;

a roller is disposed on a front end of the extendable shaft and is placed on the ground; and the footrest is disposed on a front end of the extendable shaft.

2. The multifunction office/fitness chair according to claim 1, wherein the roller reduces resistance forces when the extendable shaft moves back and forth.

* * * * *